US005460020A

United States Patent [19]

Hungerford

[11] Patent Number: 5,460,020

[45] Date of Patent: Oct. 24, 1995

[54] KEY SAFE

[75] Inventor: Robert E. Hungerford, No. Renton, Wash.

[73] Assignee: Access Technology Inc., Renton, Wash.

[21] Appl. No.: 278,567

[22] Filed: Jul. 21, 1994

Related U.S. Application Data

[63] Continuation of Ser. No. 983,914, Dec. 1, 1992, abandoned.

[51] Int. Cl.[6] ..... E05B 65/52

[52] U.S. Cl. ..... 70/63; 70/279; 109/53; 109/57; 340/568

[58] Field of Search ..... 70/62, 63, 277–279; 109/45, 46, 48, 50–52, 54, 57; 248/551–553, 205.1; 211/4, 71, 81, 84, 86; 340/568

[56] References Cited

U.S. PATENT DOCUMENTS

| | | | |
|---|---|---|---|
| 3,146,739 | 9/1964 | Furman | 109/52 |
| 3,391,256 | 7/1968 | Nawman | 70/63 |
| 4,615,281 | 10/1986 | Gaston | 70/63 X |
| 4,638,746 | 1/1987 | Ishigure | 109/52 |
| 4,651,544 | 3/1987 | Hungerford | 70/63 |
| 4,768,021 | 8/1988 | Ferraro | 109/53 X |
| 4,838,052 | 6/1989 | Williams et al. | 70/63 |
| 4,916,443 | 4/1990 | Barrett et al. | 70/63 X |
| 4,987,836 | 1/1991 | Owen | 70/63 X |
| 5,129,330 | 7/1992 | McKay et al. | 70/63 X |
| 5,154,456 | 10/1992 | Moore et al. | 248/552 X |
| 5,170,907 | 12/1992 | Sakai | 109/52 X |

FOREIGN PATENT DOCUMENTS

| | | | |
|---|---|---|---|
| 405061 | 1/1991 | European Pat. Off. | 70/63 |
| 679059 | 12/1991 | Switzerland | 70/63 |

OTHER PUBLICATIONS

OSI Security Devices, "OMNILOCK", Date Unknown.
Marlok, "Solitaire System", Date Unknown.
Schlage, "Key'n Keyless", Date Unknown.
Continental Instruments Corp., "CardAccess 25", Date Unknown.
Simplex Security Systems, Inc., "Unican 1000", Date Unknown.
Supra Products, Inc., "All Purpose KeyBox" and Homeowner KeyBox, Date unknown.
Yale Security Inc., "The Touchcode System", Date Unknown.

*Primary Examiner*—Peter M. Cuomo
*Assistant Examiner*—Suzanne L. Dino
*Attorney, Agent, or Firm*—Limbach & Limbach

[57] ABSTRACT

A key safe includes an outer housing for housing a key, a releasable mounting assembly, a releasable opening assembly, an electronic code entry pad, and activation circuitry. The releasable mounting assembly releasably mounts the outer housing to a mounting surface so that the outer housing may be completely removed from the mounting surface. The releasable opening assembly permits access to the interior region of the outer housing by permitting the outer housing to be moved from a closed position to an open position. The electronic code entry pad is positioned in one or more of the outer housing walls and is exposed to the exterior of the outer housing so that the code entry pad is accessible to a user for entry of a key code. The activation circuitry is positioned in the interior region of the outer housing and is responsive to the electronic code entry pad for selectively releasing the releasable mounting assembly and the releasable opening assembly. In another embodiment, external power source circuitry is used to provide power from a power source positioned outside the outer housing to the electronic code entry assembly and the latch activation circuitry. In yet another embodiment, the activation circuitry includes circuitry for digitally storing time data when a valid key code is entered.

23 Claims, 14 Drawing Sheets

MAP

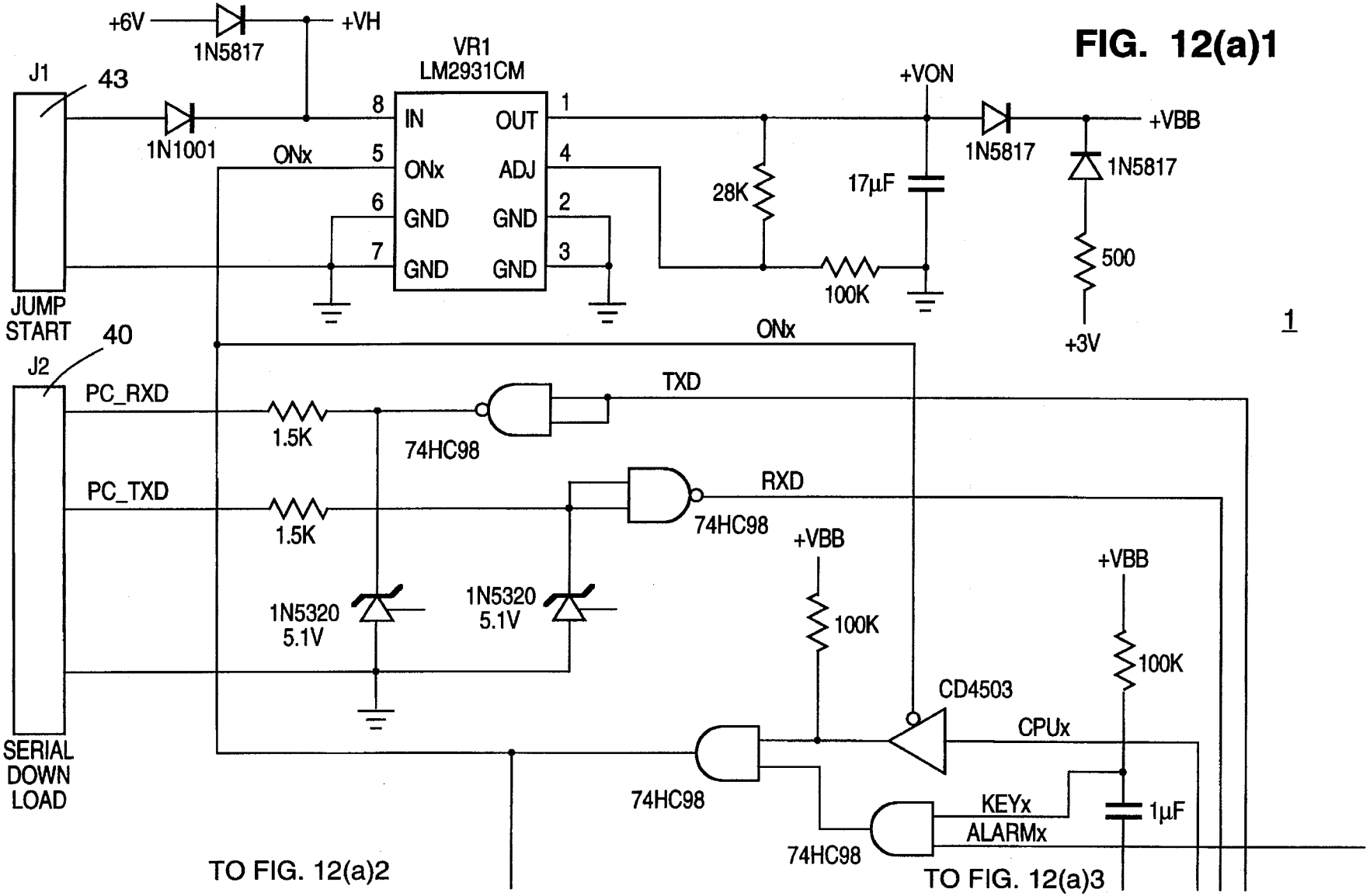
FIG. 12(a)1
1
+VBB
1N5817
500
+3V
1N5817
+VON
17µF
100K
28K
+VH
1N5817
+6V
1N1001
VR1
LM2931CM
IN
ONx
GND
GND
GND
ADJ
OUT
ONx
TXD
RXD
74HC98
74HC98
74HC98
74HC98
1.5K
1.5K
1N5320
5.1V
1N5320
5.1V
+VBB
100K
+VBB
100K
CD4503
CPUx
KEYx
ALARMx
1µF
TO FIG. 12(a)3
TO FIG. 12(a)2
J1
43
JUMP START
J2
40
PC_RXD
PC_TXD
SERIAL DOWN LOAD

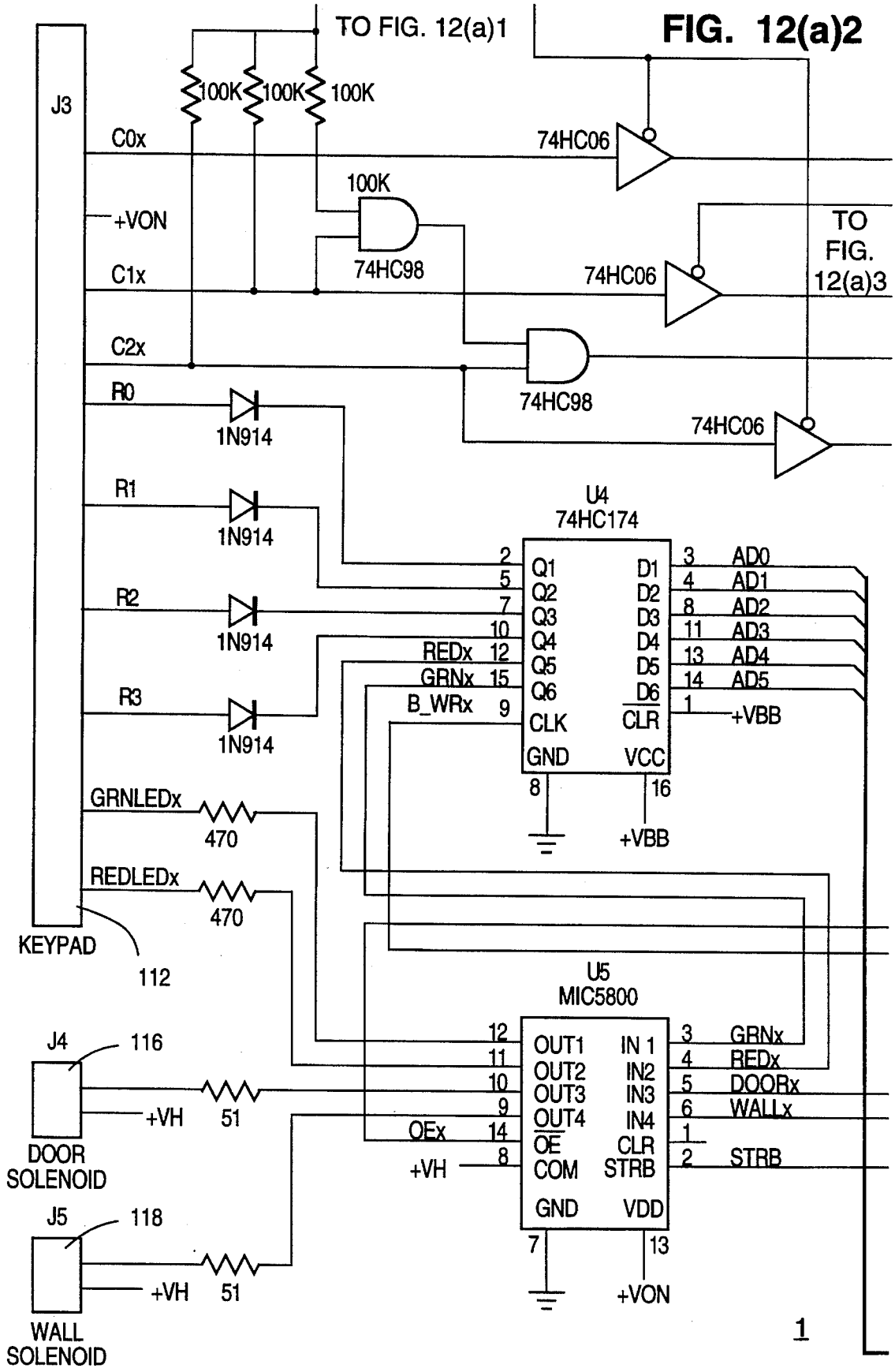
TO FIG. 12(a)1
FIG. 12(a)2
J3
100K
100K
100K
C0x
74HC06
100K
+VON
74HC98
C1x
74HC06
TO FIG. 12(a)3
C2x
74HC98
R0
1N914
74HC06
R1
1N914
U4
74HC174
R2
1N914
R3
1N914
REDx
GRNx
B_WRx
AD0
AD1
AD2
AD3
AD4
AD5
+VBB
GRNLEDx
470
REDLEDx
470
KEYPAD
112
U5
MIC5800
J4
116
+VH
51
DOOR SOLENOID
OEx
+VH
GRNx
REDx
DOORx
WALLx
STRB
J5
118
+VH
51
WALL SOLENOID
+VON
1

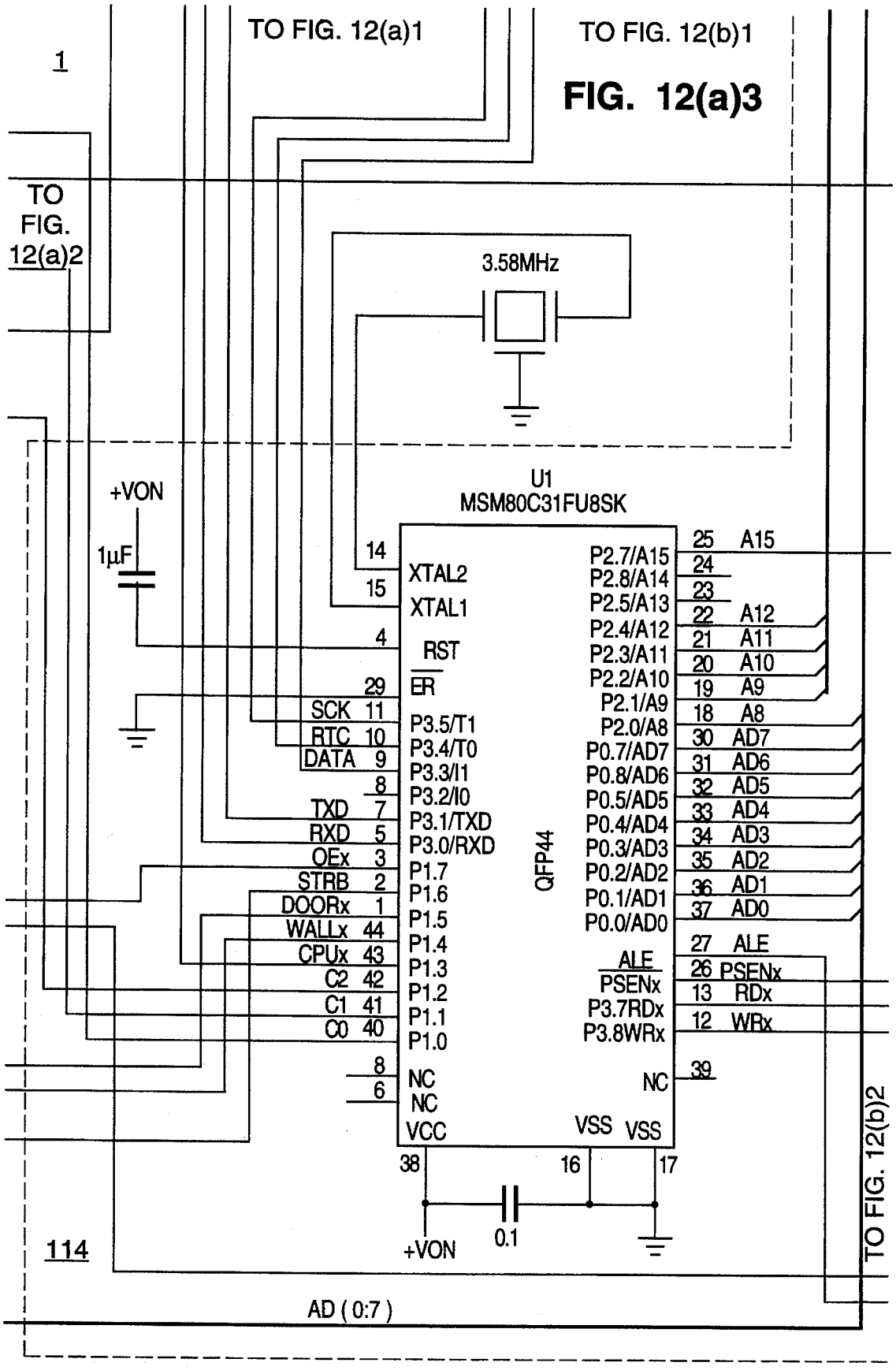
FIG. 12(a)3

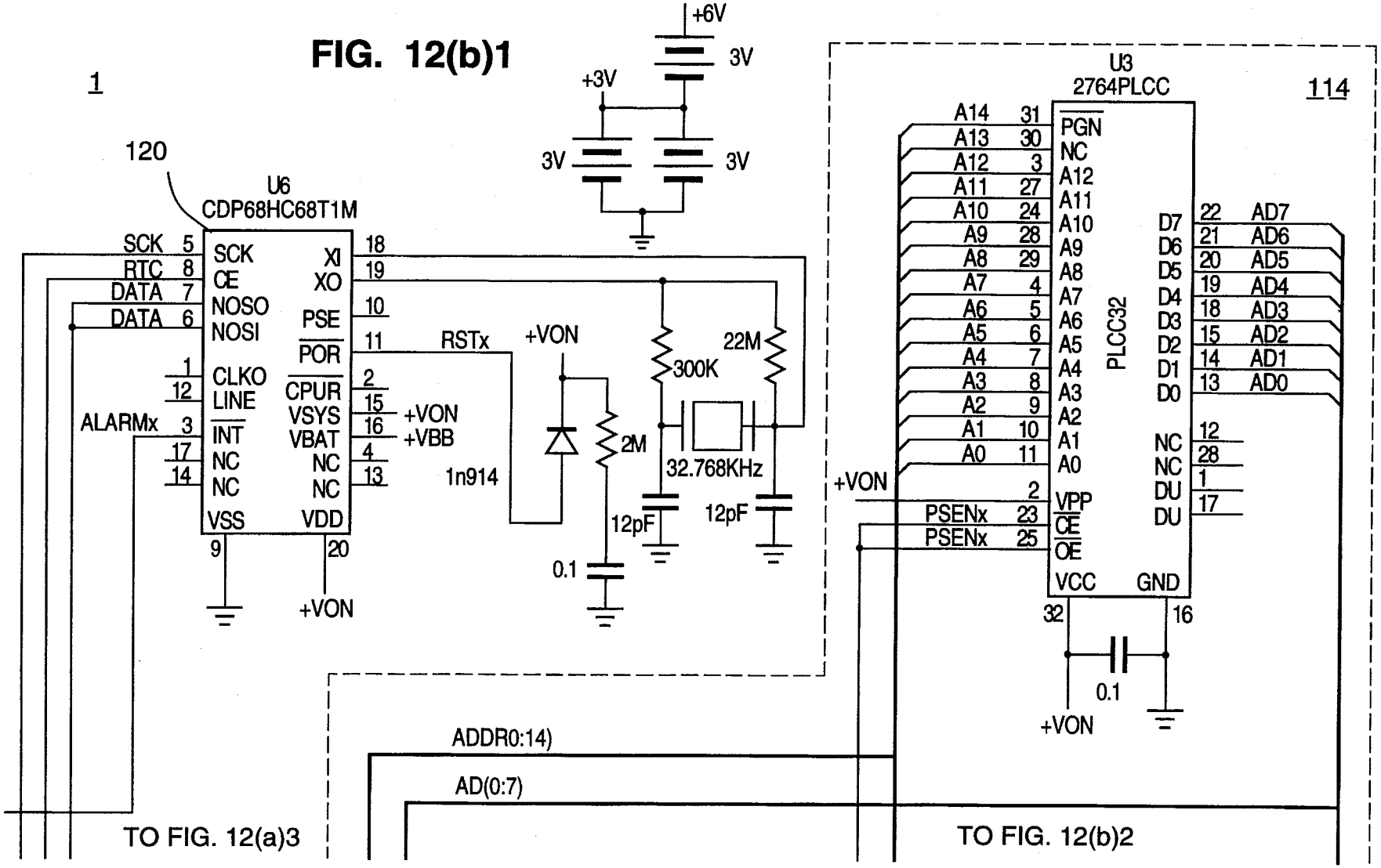
FIG. 12(b)1

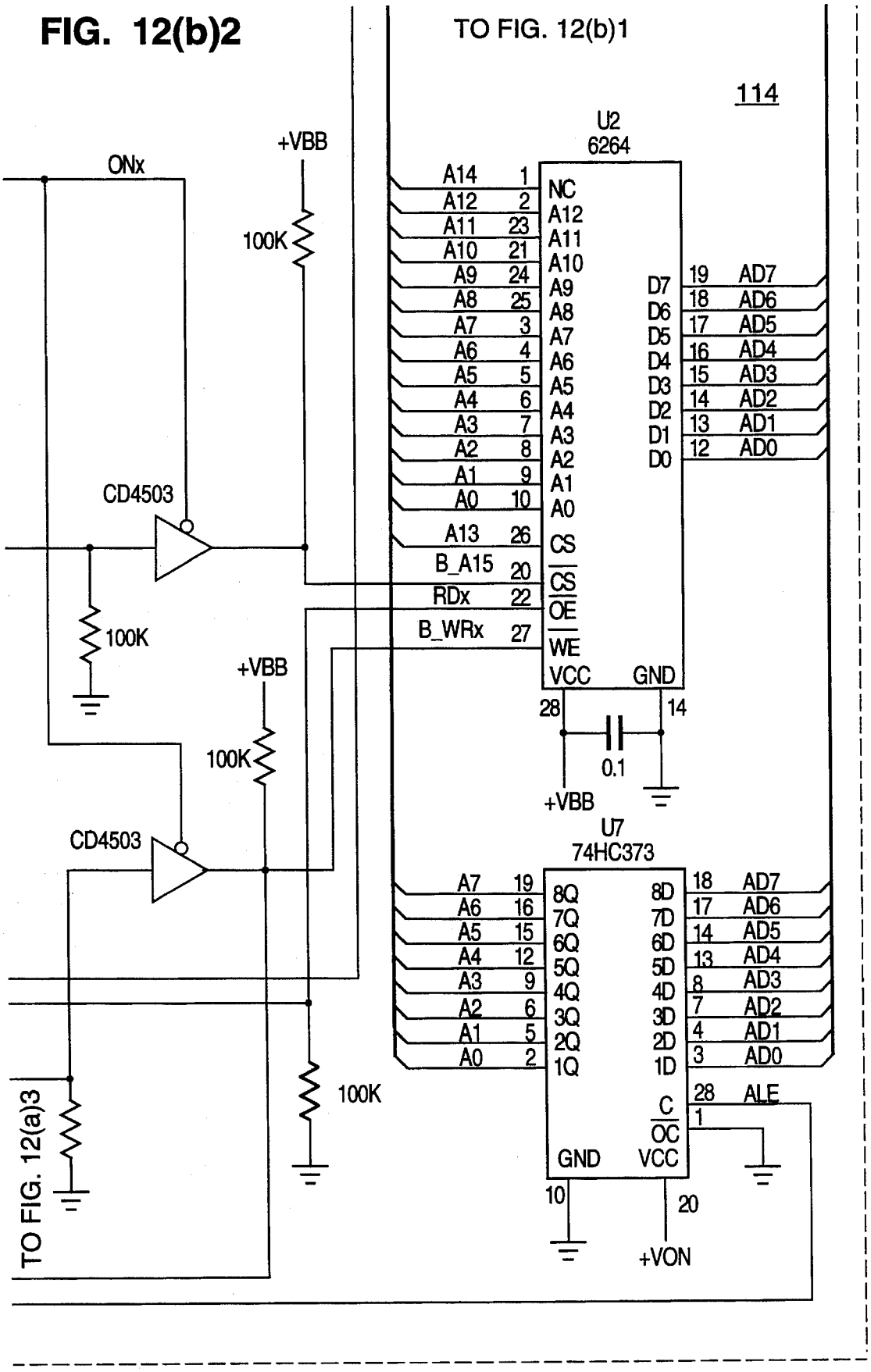
FIG. 12(b)2
TO FIG. 12(b)1
114
U2
6264
ONx
+VBB
100K
CD4503
100K
+VBB
100K
CD4503
A14 1 NC
A12 2 A12
A11 23 A11
A10 21 A10
A9 24 A9
A8 25 A8
A7 3 A7
A6 4 A6
A5 5 A5
A4 6 A4
A3 7 A3
A2 8 A2
A1 9 A1
A0 10 A0
A13 26 CS
B_A15 20 CS
RDx 22 OE
B_WRx 27 WE
VCC GND
28 14
0.1
+VBB
D7 19 AD7
D6 18 AD6
D5 17 AD5
D4 16 AD4
D3 15 AD3
D2 14 AD2
D1 13 AD1
D0 12 AD0
U7
74HC373
A7 19 8Q
A6 16 7Q
A5 15 6Q
A4 12 5Q
A3 9 4Q
A2 6 3Q
A1 5 2Q
A0 2 1Q
8D 18 AD7
7D 17 AD6
6D 14 AD5
5D 13 AD4
4D 8 AD3
3D 7 AD2
2D 4 AD1
1D 3 AD0
28 ALE
C 1
OC
GND VCC
10 20
+VON
100K
TO FIG. 12(a)3

KEY SAFE

This is a File Wrapper Continuation of application Ser. No. 07/983,914, filed on Dec. 01, 1992, now abandoned.

BACKGROUND OF THE INVENTION

This invention relates to an electronic door or wall mounted key safe which allows selective access to the interior of the safe so that various categories of users can be provided key access (or access to the safe for maintenance purposes) while maintaining a high level of security against unwanted users.

Manual key safes are a well-known means of providing selective access to a key which can then be used to open a door, or be used for access to any secured device, such as electronic or manual HVAC controllers, or process controllers in industrial settings. A common application is in the real estate business where numerous agents require access to a single lock but it is not cost effective or appropriate from a security standpoint to provide all such persons keys to that lock.

Numerous key safes appear in the prior art. My own prior invention, detailed in U.S. Pat. No. 4,651,544, describes a combination electronic/manual key safe the interior of which includes a tethered, retractable key. The retractable key is held within a separate key compartment which can be accessed only by electronically or manually manipulating a solenoid activated latch. While the key safe of U.S. Pat. No. 4,651,544 represented a significant advance in key safe technology, certain problems inherent to providing wide ranging access, i.e. to various categories of users, while at the same time maintaining a completely secure system were not addressed in that invention.

In particular, my earlier invention still required the use of a "hard" key in some circumstances. By "hard" key, I mean a standard physical (as opposed to an electronic code) key which is used for access to the key safe which in my earlier invention was used by a specific category of user, or during a power failure. For this reason it is an object of the present invention to provide an electronic key safe for which no "hard" key access is necessary under any circumstances.

Specifically, it is a further object of this invention to provide such a key safe which eliminates the need for hard key access even during power failures, and without compromising the security of the system.

SUMMARY OF THE INVENTION

To meet these and other objects, the present invention provides a key safe having an outer housing, a releasable mounting assembly, a releasable opening assembly, an electronic code entry pad, and activation circuitry. The outer housing is for housing a key and includes walls that define an interior region in which a hard key is kept. The releasable mounting assembly mounts the outer housing to a wall, door or other surface so that the outer housing may be completely removed from that surface upon entry of an electronic code, e.g. when maintenance is required. The releasable opening assembly permits access to the interior region of the outer housing when an electronic code is entered, e.g. to allow access to the key inside the housing. An electronic code entry pad is positioned in the outer housing walls and is exposed to the exterior of the outer housing so that a code entry pad is accessible to a user for entry of a key code. Activation circuitry is positioned in the interior of the housing and is responsive to the electronic code entry pad for selectively releasing the releasable mounting assembly and the releasable opening assembly.

In one embodiment of the invention, the releasable mounting assembly includes an electronics member positioned within the outer housing, a mounting bracket for mounting on the mounting surface, and a mounting latch for latching the electronics member to the mounting bracket. The releasable opening assembly includes an outer housing latch for latching the outer housing to the electronics member. The activation circuitry selectively releases the mounting latch and the outer housing latch depending on the code which is entered.

In the preferred embodiment, internal power source circuitry is used to provide power from a battery to the electronic code entry assembly and the latch activation circuitry. Furthermore, an external power source circuit can be used to provide power from an external power source to the electronic code entry assembly and the latch activation circuitry, allowing the system to be "jump started" if the battery fails. This eliminates the need to use a hard key even during battery failure.

In another embodiment of the invention, the latch activation circuitry includes circuitry for digitally storing time and user data when a valid key code is entered.

A better understanding of the features and advantages of the invention will be obtained by reference to the following detailed description of the invention and accompanying drawings which set forth an illustrative embodiment in which the principles of the invention are utilized.

DETAILED DESCRIPTION OF THE PREFERRED EMBODIMENTS

Figure 1:
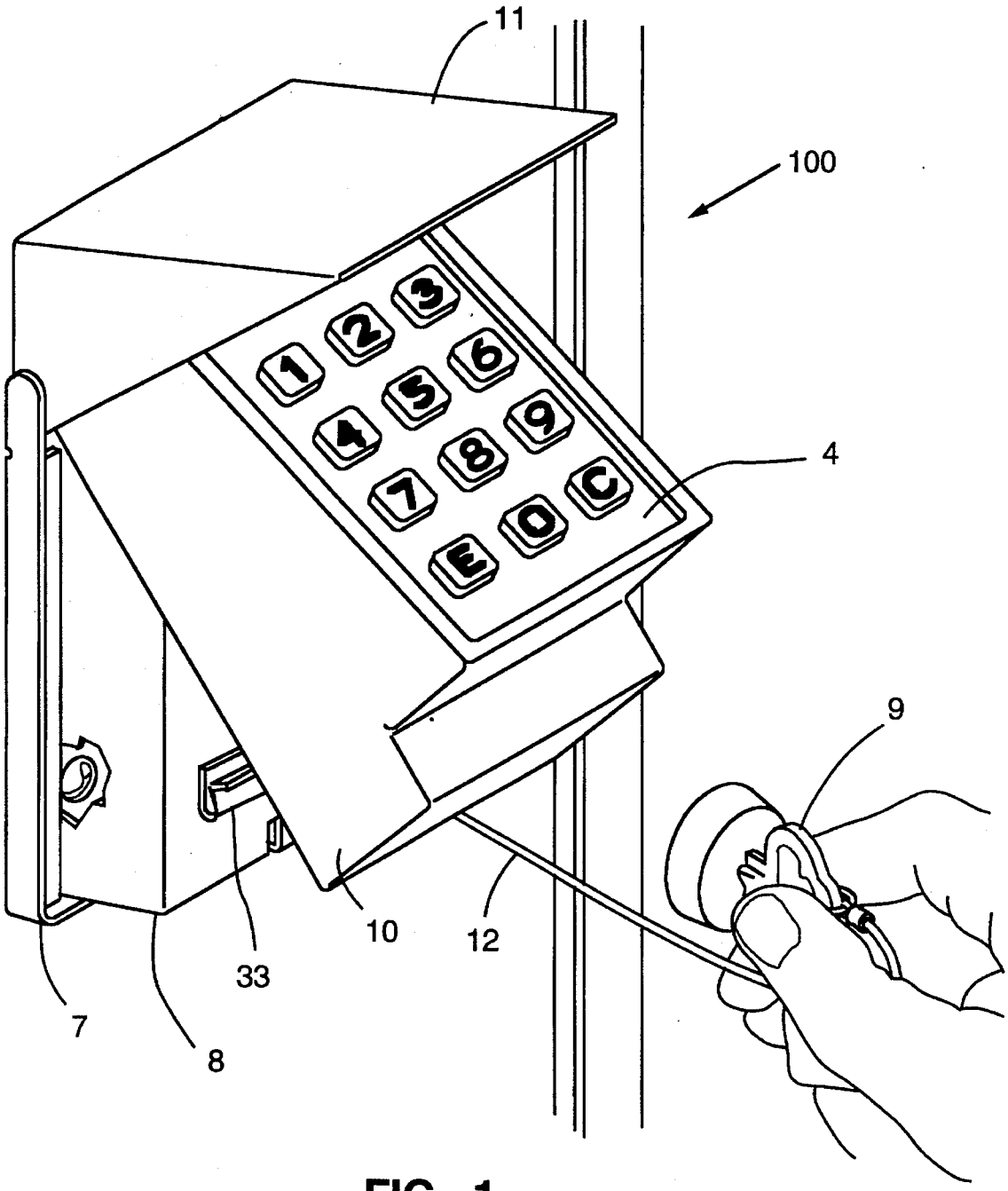
FIG. 1 is a perspective view illustrating one embodiment of a key safe in accordance with the present invention.

Referring to FIG. 1, there is illustrated an embodiment of a key safe 100 in accordance with the present invention. In its preferred embodiment, the key safe 100 is a self contained, battery operated, electronically controlled key containment vault. It holds in safe keeping nearly any key 9 for nearly any purpose. Upon entry of a valid key code via electronic key pad 4, the internal electronics permit outer housing 10 to be opened to expose key 9. Upon entry of another valid key code, the entire unit may be completely removed from the wall in order to expose the unit's internal components. Key safe 100 includes features that permit it to store and/or process key code data, and it may even include a remote access port for interfacing with and controlling a remote device or piece of equipment.

Outer housing 10 generally has a front wall, a top wall and side walls defining an interior region and is used for housing key 9, as well as the latches and internal electronics of key safe 100 (discussed below). Outer housing 10 is preferably molded or manufactured out of weather and vandal resistant metal, plastic, resins or composite materials, and it is preferably constructed so that the sides have large angles. This preferred construction is both for appearance and to provide a slanted surface that deflects a direct blow from any object, which is important for the security of the device. Furthermore, the construction provides a low profile to the unit that reduces the possibility of injury from bumping into it.

Key chain, cable, lanyard or tether 12 is attached to key 9 by a rivet or other attachment hardware. The other end of key chain 12 is preferably connected to a retractable (self coiling) lanyard or tether assembly 5 (see FIG. 2) positioned within outer housing 10. Key safe 100 is mounted to a wall or other mounting surface by means of mounting bracket 7.

Electronic code entry key pad assembly 4 is preferably mounted on the front wall of the outer housing 10. While the front wall is preferred, key pad assembly 4 may alternatively be mounted in one or more of the other outer housing 10 walls provided it is exposed to the exterior of the outer housing 10 so that it is accessible to a user for entry of a key code. Cover 11 may be used to protect the key pad assembly 4 from weather and vandalism.

Figure 2:
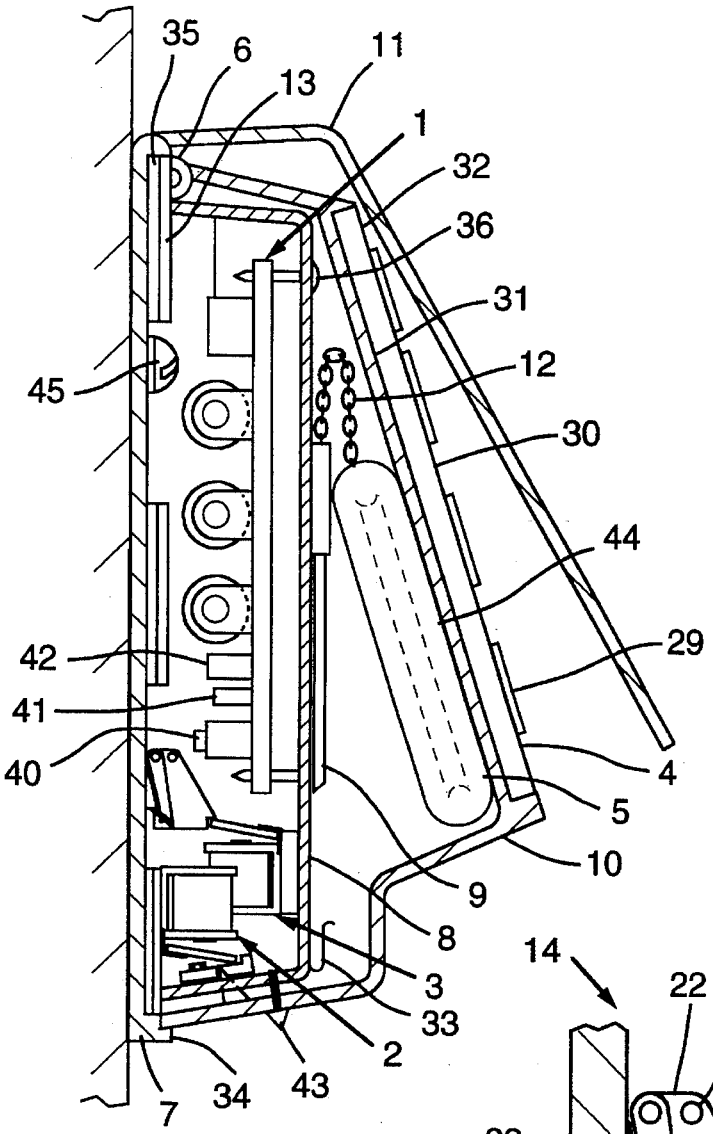
FIG. 2 is a cross-sectional view of the key safe of FIG. 1.

Referring to FIG. 2, there is illustrated a detailed cross-sectional view of key safe 100 of FIG. 1. Mounting bracket 7, a plate having holes for bolts or fasteners, may be mounted to the mounting surface by means of mounting hardware 45. Mounting hardware 45 may include bolts, screws, or the like. Mounting bracket 7 includes recess 34 that extends beyond the point where outer housing 10 makes contact with mounting bracket 7. Recess 34 prevents the outer housing from being pried open.

Electronics housing 8 is positioned over mounting bracket 7 and within the outer housing 10; thus, components that are attached to the electronics housing 8 are also located within the interior region of the outer housing 10. Electronics housing 8 includes a front wall and side walls similar to outer housing 10. However, because one of the primary functions of electronics housing 8 is for mounting many of the internal components of key safe 100, it is believed that many different configurations of the electronics housing 8 will be adequate. Therefore, electronics housing 8 will be referred to hereinafter as simply electronics "member" 8.

Electronics member 8 includes a series of mounting slides 35 which mate with complimentary series of mounting slides 13 located on mounting bracket 7. Mounting bracket 7 includes a receiving slot around three surfaces to receive mounting slides 35 in electronics member 8. Mounting slides 13 and 35 enable electronics member 8 to be removed from the mounting bracket 7 by an upward sliding motion. Removal of electronics member 8 in this manner permits access to the interior components of key safe 100.

Outer housing 10 is secured over and to electronics member 8 by means of a hinge 6. By using hinge 6, no hardware is required to interconnect each sub-assembly to complete the final assembly. This design is very manufacturable at a reasonable price. It also provides for modular "field" repairs & part(s) replacement without the need to take the unit back to the shop.

Specifically, hinge 6 secures one of the walls of the outer housing 10 to the upper portion of the electronics member 8. By securing outer housing 10 to electronics member 8 in this manner, access may be gained to key 9 located in the interior of outer housing 10 by rotating outer housing 10 from a closed position to an open position. Outer housing 10 further includes a mounting cavity for key pad assembly 4.

Cover 11 that protects exposed key pad assembly 4 from weather and vandalism is secured over the outer housing 10 by means of hinge 6. Cover 11 is simply lifted and rotated about hinge 6 when a user wishes to access to key pad assembly 4.

Retractable key tether assembly 5 is positioned inside outer housing 10 between electronics member 8 and outer housing 10. Tether assembly 5 includes retractable coil assembly 44, a chain, cable or tether 12, and key 9. Retractable coil assembly 44 is spring loaded and is the reel on which tether 12 retracts. The retractable key tether assembly "hard mounts" the key 9 to key safe 100 and eliminates lost, stolen or misplaced keys. In an alternative embodiment, retractable key tether assembly 5 may be replaced with a key clip 33. Key clip 33 will secure key 9 in key safe 100, but, because there is no "hard mounting", key 9 may be completely removed from key safe 100. Furthermore, other objects, such as credit cards, electronic card keys, notes or money, may be placed into key clip 33 for others to retrieve.

An electronics printed circuit board (PCB) 1 is mounted to and surrounded by electronics member 8. Several electronic standoffs 36, preferably four, are pressed into the electronics member 8. PCB 1 is pressed on to standoffs 36 for mounting. PCB 1 contains many of the electrical components (discussed below) of key safe 100, including the batteries.

Figure 3:
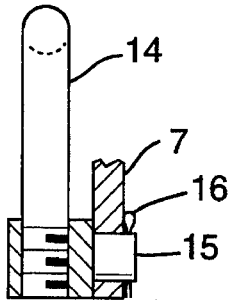
FIG. 3 is a cross-sectional view illustrating an alternative method of mounting the key safe of FIG. 1.

Referring to FIG. 3, there is illustrated an alternative method of mounting key safe 100. Key safe 100 may be suspended from a door knob, a pipe, or any other solid and unmovable object by means of a shackle 14. Shackle 14 may either be a slotted, flat metal bracket that mounts to the unmovable object or a U-shaped bolt and preferably is of a minimum radius to prevent gaps which may facilitate an effort to pry the unit off a door knob. It is connected to mounting bracket 7 via attachment pin 15. Attachment pin 15 is held in place by retainer 16.

Figure 4:
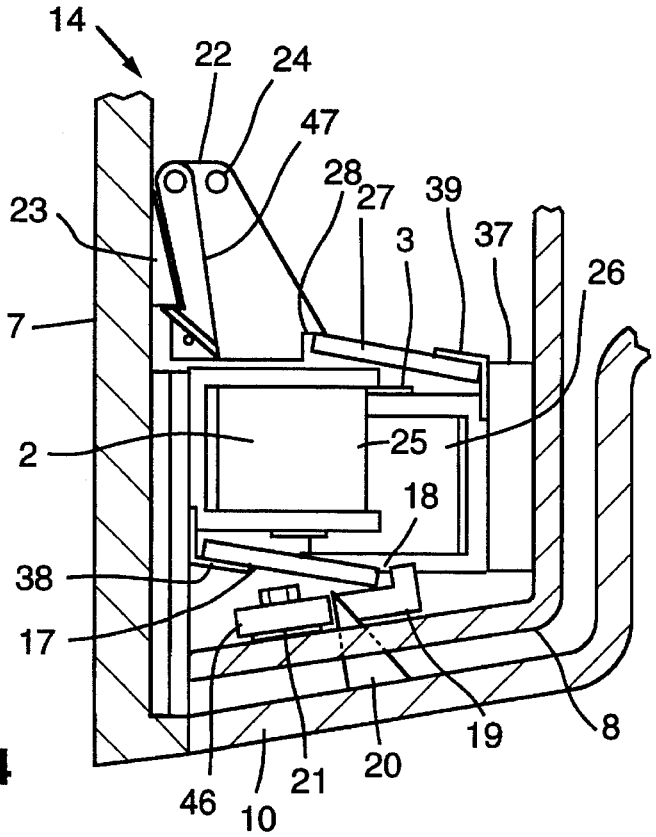
FIG. 4 is an expanded cross-sectional view of the key safe latching mechanisms of FIG. 2.

Referring to FIG. 4, there is illustrated an expanded cross-sectional view of the lower portion of key safe 100. An outer housing latch assembly 2, positioned within electronics member 8, is used for latching outer housing 10 to electronics member 8. Outer housing latch assembly 2, along with hinge 6, provide the means that permit outer housing 10 to be released and access to be gained to the interior region of the outer housing 10. When outer housing latch assembly 2 is released, outer housing 10 may be moved from a closed position to an open position so that the key 9 is accessible. When outer housing 10 is returned to the closed position, the latch assembly 2 latches outer housing 10 in the closed position.

Specifically, outer housing latch assembly 2 is constructed similar to a relay. An electrical coil 25 is mounted to electronics member 8. When coil 25 is energized, an armature 17 is pulled in towards coil 25. Armature 17 controls the locking and unlocking of the outer housing latch assembly 2. One end of the armature 17 is mounted to coil 25 by means of a reset or "leaf" spring 38. Reset spring 38 holds armature 17 in the open or in the locked position. The other end of armature 17 is positioned near a detent in a holding bar 19. Holding bar 19 is pivotally fixed to the electronics member 8 at a pivot point 21. Pivot point 21 is the point on electronics member 8 at which most of the force is directed if one attempts to pry outer housing 10 open.

Figure 5A:
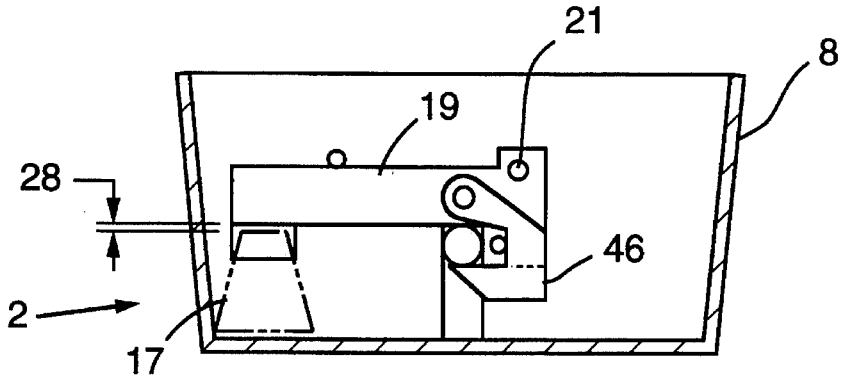
FIGS. 5(*a*) through 5(*c*) are views illustrating the operation of an outer housing latch assembly in accordance with the present invention.
Figure 5B:
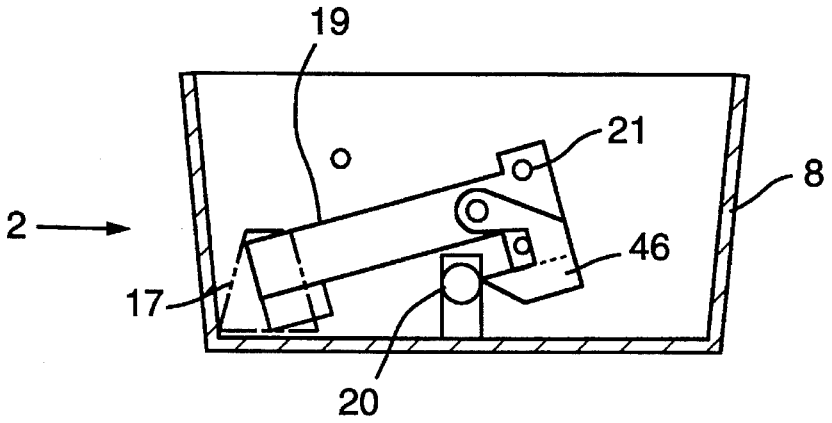
Figure 5C:
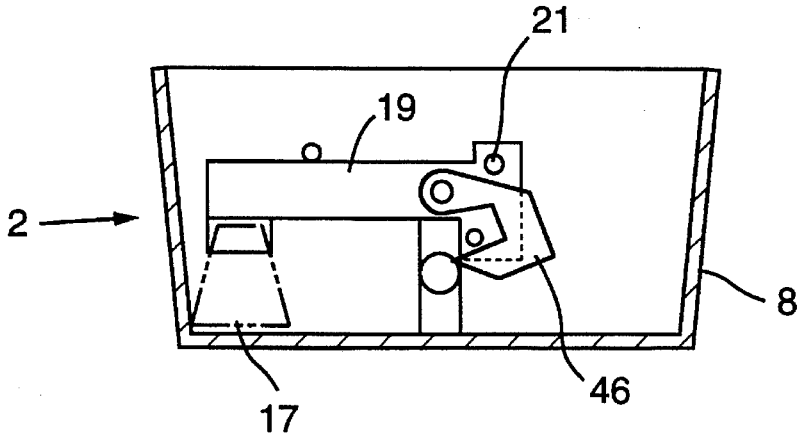
Figure 6A:
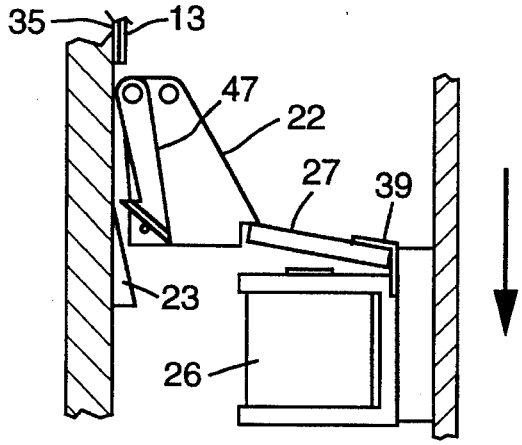
FIGS. 6(*a*) through (6*e*) are cross-sectional views illustrating the operation of a mounting latch assembly in accordance with the present invention.
Figure 6B:
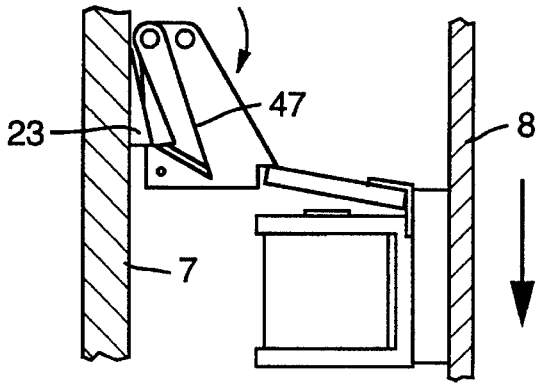
Figure 6C:
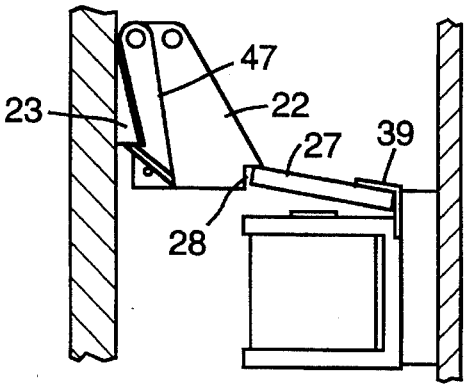
Figure 6D:
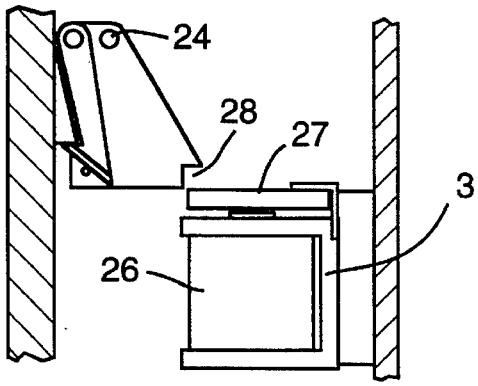
Figure 6E:
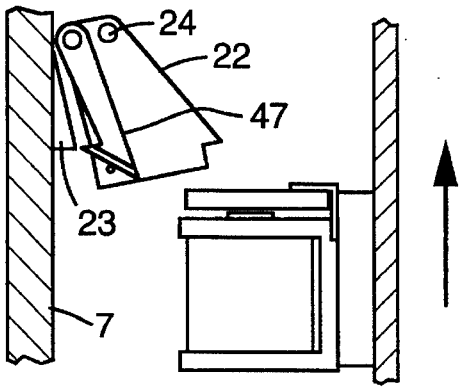

FIGS. 5(*a*) through 5(*c*) illustrate outer housing latch assembly 2 in greater detail. FIG. 5(*a*) illustrates outer housing latch assembly 2 in its closed mode, i.e., coil 25 is not energized and armature 17 is in its out position. In this mode, armature 17 prevents holding bar 19 from rotating about pivot point 21. Because holding bar 19 cannot rotate, it is held against an outer housing locking pin 20.

Outer housing locking pin 20 is an integral part of outer housing 10. It is the point where outer housing 10 is latched to electronics member 8. Specifically, an outer housing latch keeper 46 is pivotally fixed to holding bar 19. Keeper 46 wraps around outer housing locking pin 20 and prevents the outer housing from opening.

FIG. 5(*b*) illustrates outer housing latch assembly 2 in its open mode, i.e., coil 25 is energized and armature 17 is pulled in towards coil 25. Because armature 17 is pulled in towards coil 25, holding bar 19 is free to rotate about pivot point 21. As outer housing 10 is pulled open, outer housing locking pin 20 makes contact with keeper 46 and causes holding bar 19 to rotate. As holding bar 19 rotates, keeper 46 is removed from outer housing locking pin 20, and outer housing 10 opens. Holding bar 19 is spring loaded so when locking pin 20 passes keeper 46 holding bar 19 resets to a locked position.

FIG. 5(*c*) illustrates outer housing latch assembly 2 returning to its closed mode, i.e., coil 25 is no longer energized and armature 17 is in its out position. As outer housing 10 approaches its closed position, outer housing locking pin 20 makes contact with outer angled part of keeper 46. Keeper 46 is pushed out of the way and outer housing locking pin 20 is returned to its position against holding bar 19. A spring in keeper 46 causes it to wrap around outer housing locking pin 20 which latches outer housing 10 closed.

The movement of the armature 17 by energized coil 25 is unrestricted by the other components of outer housing latch assembly 2. Armature 17 moves free of the detent in holding bar 19 because of a small air gap 18. Air gap 18 provides near frictionless movement of the armature 17. Thus, this arrangement is extremely advantageous in that coil 25 requires very little power from the batteries to move the armature 17, which results in low power consumption.

An attempt to force outer housing 10 open will cause the holding bar 19 to move into air gap 18 so that the detent in holding bar 19 makes contact with the armature 17. This contact will hold the unit closed. Thus, the unit can resist a large crushing force. Furthermore, armature 17 and coil 25 are preferably positioned and shock mounted so that a blow to the unit will not jar armature 17. Thus, any attempt to actuate armature 17 by a direct blow to the unit will fail.

Referring again to FIGS. 2 and 4, a mounting latch assembly 3 (or "un-mount latch assembly 3") is used for latching electronics member 8 to the mounting bracket 7. Mounting latch assembly 3, along with electronics member 8 and mounting bracket (or member) 7, provide the means for releasably mounting outer housing 10 to the mounting surface so that outer housing 10 and electronics member 8 may be completely removed from the mounting surface. When outer housing 10 and electronics member 8 are completely removed from the mounting surface, access may be gained to all of the internal components of the unit for maintenance, battery replacement, downloading of information, programming, etc. (discussed below). This releasable mounting feature also includes mounting slides 35 and 13. Mounting latch assembly 3 prevents electronics member 8 from sliding relative to the mounting bracket 7 along mounting slides 13 and 35.

Similar to outer housing latch assembly 2, coil 26 actuates a mounting armature 27. Mounting armature 27 is secured to coil 26 by means of an armature reset spring 39. Armature reset spring 39 holds armature 27 in the open or locked position.

Mounting armature 27 controls the locking and unlocking of latch assembly 3 by preventing movement of a mounting holding bar 22. Mounting holding bar 22 is pivotally connected to the electronics member 8 at pivot point 24. Pivot point 24 is the point on the electronics member 8 at which most of the force is directed in an attempt to pry the unit open.

Mounting bracket 7 includes a mounting bracket locking pin 23 as its locking point. Locking pin 23 is an integral part of mounting bracket 7 and is the locking point for electronics member 8 and mounting bracket 7. Mounting holding bar 22 prevents movement of electronics member 8 relative to mounting bracket 7 by causing a mounting keeper 47 to remain engaged with mounting bracket locking pin 23. An air gap 28, similar to air gap 18, separates mounting armature 27 from mounting holding bar 22.

FIGS. 6(*a*) through 6(*e*) illustrate the operation of mounting latch assembly 3. Specifically, FIG. 6(*a*) illustrates electronics member 8 as it begins to slide down the mounting slides 13 and 35. Because coil 26 is not energized, armature 27 is in its out position which prevents mounting holding bar 22 from rotating. As electronics member 8 continues to slide, mounting keeper 47 slides over mounting bracket locking pin 23, as illustrated in FIG. 6(*b*). Because mounting keeper 47 is spring loaded, it snaps into locked position once it reaches the end of mounting bracket locking pin 23, as illustrated in FIG. 6(*c*). Once mounting keeper 47 is snapped into locking position, it will prevent sliding motion between electronics member 8 and mounting bracket 7 until coil 26 is energized.

FIG. 6(*d*) illustrates the manner in which electronics member 8 is unmounted from the mounting bracket 7. When coil 26 is energized, armature 27 is pulled through air gap 28 and in towards coil 26. Similar to outer housing latch assembly 2, power consumption is very low because air gap 28 prevents friction between armature 27 and mounting holding bar 22. The movement of armature 27 permits mounting holding bar 22 to rotate about pivot point 24.

FIG. 6(*e*) illustrates the effect of a user entering a valid key code, the coil 26 being energized, and the user pushing electronics member 8 in an upward direction. As mounting keeper 47 is pushed against mounting bracket locking pin 23, mounting holding bar 22 rotates. This rotation occurs rather easily because pivot point 24 is offset from mounting bracket locking pin 23. Once mounting keeper 47 is disengaged from mounting locking pin 23, electronics member 8 may be completely removed by continuing the upward sliding motion.

Figure 7:
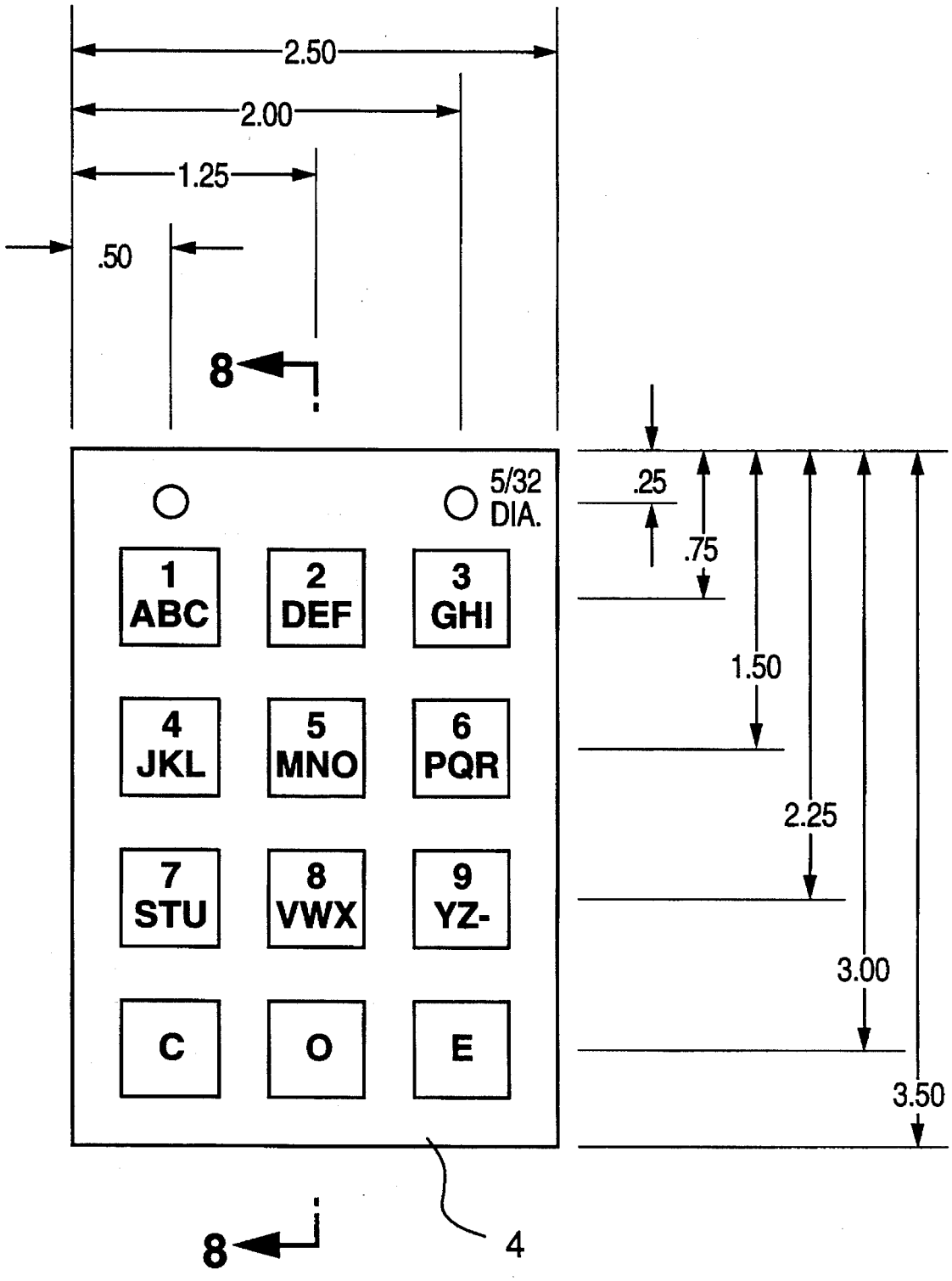
FIG. 7 is a front view illustrating an electronic code entry key pad assembly in accordance with the present invention.

Outer housing latch assembly 2 and mounting latch assembly 3 are activated for 4 to 10 seconds and then released after a user enters a valid key code in electronic code entry key pad assembly 4. FIG. 7 illustrates the preferred dimensions of key pad assembly 4. Key pad assembly 4 preferably includes twelve vandal and weather resistant keys 29 and a vandal and weather resistant bezel 30. Keys 29 preferably have alpha/numerical legends.

Green and red LEDs 32 are included on key pad assembly 4. The LED indicators 32 are used for programming or operation of the unit and annunciate the inputs and their validity or the condition of the batteries. For example, LEDs 32 indicate a correctly entered code, whether the unit is in a lockout mode, whether the batteries are low, or whether an incorrect code has been entered.

Figure 8:
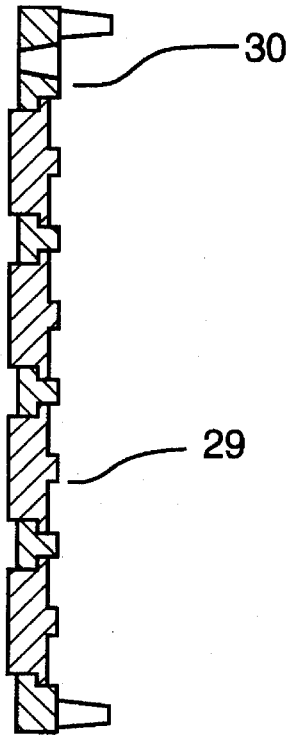
FIG. 8 is a cross-sectional view taken along line 8—8 of FIG. 7.
Figure 9:
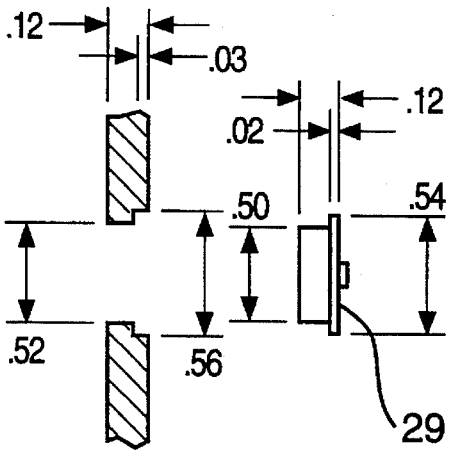
FIG. 9 is a cross-sectional view of one of the keys shown in FIG. 7.

FIG. 8 illustrates a cross-sectional view of key pad assembly 4. Bezel 30 provides the means of mounting keys 29 and holding them in place. Keys 29 are back mounted and have flanges to eliminate the possibility of them being pried out of bezel 30. FIG. 9 illustrates the preferred dimension of keys 29.

A membrane switch 31 (illustrated schematically in FIG. 13), which is positioned below keys 29, provides the electrical switching logic between keys 29 and the internal electronics of the unit. The membrane switch 31 is sealed with a pig tail lead to connect it to the internal electronics and preferably includes "domes" having a tactual feel which give the operator a positive feeling that the switch was actuated. The domes also hold keys 29 up flush with the top of bezel 30. Membrane switch 31, which is preferably weather resistant, is protected from vandal attack by bezel 30 and keys 29. Any blow to keys 29 will force the energy from keys 29 directly into the hardened keypad base of the outer housing 10.

Figure 10A:
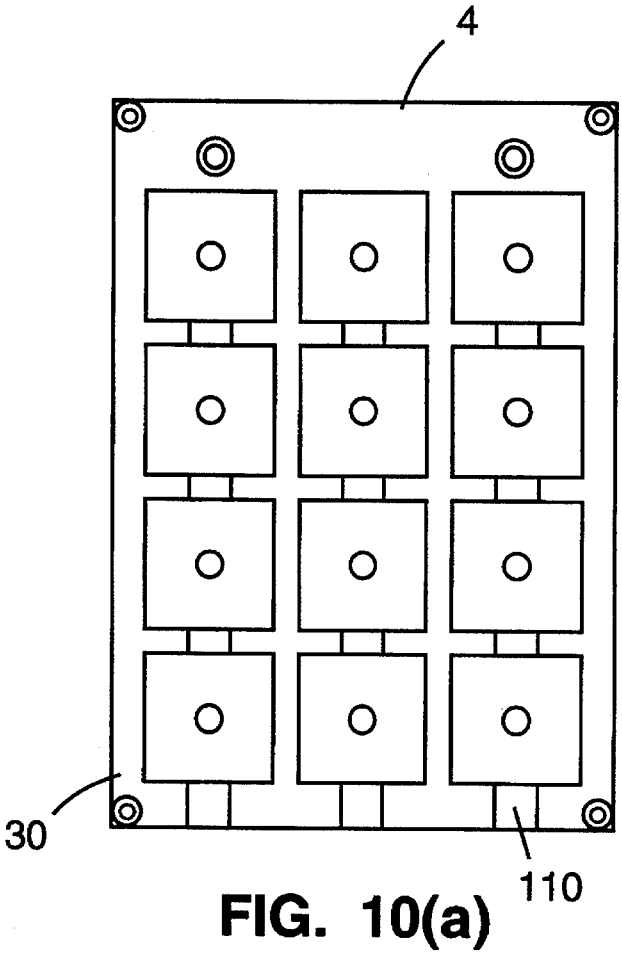
FIGS. 10(*a*) and 10(*b*) are back and side views of the key pad assembly of FIG. 7.
Figure 10B:
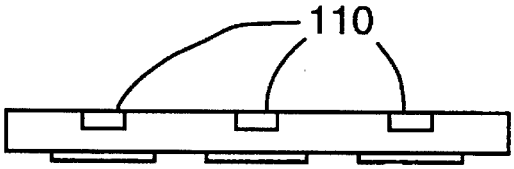

Referring to FIGS. 10(*a*) and 10(*b*), keys 29, bezel 30, and membrane switch 31 are sandwiched in the recess on the front of outer housing 10. The recess preferably has grooves in its base which correspond to grooves in bezel 30. These grooves form a set of drain holes 110 which direct liquids out of the key pad assembly 4 and further facilitate its weather resistance. The drain holes 110 eliminate the possibility of liquids accumulating in keys 29 and freezing.

Figure 11:
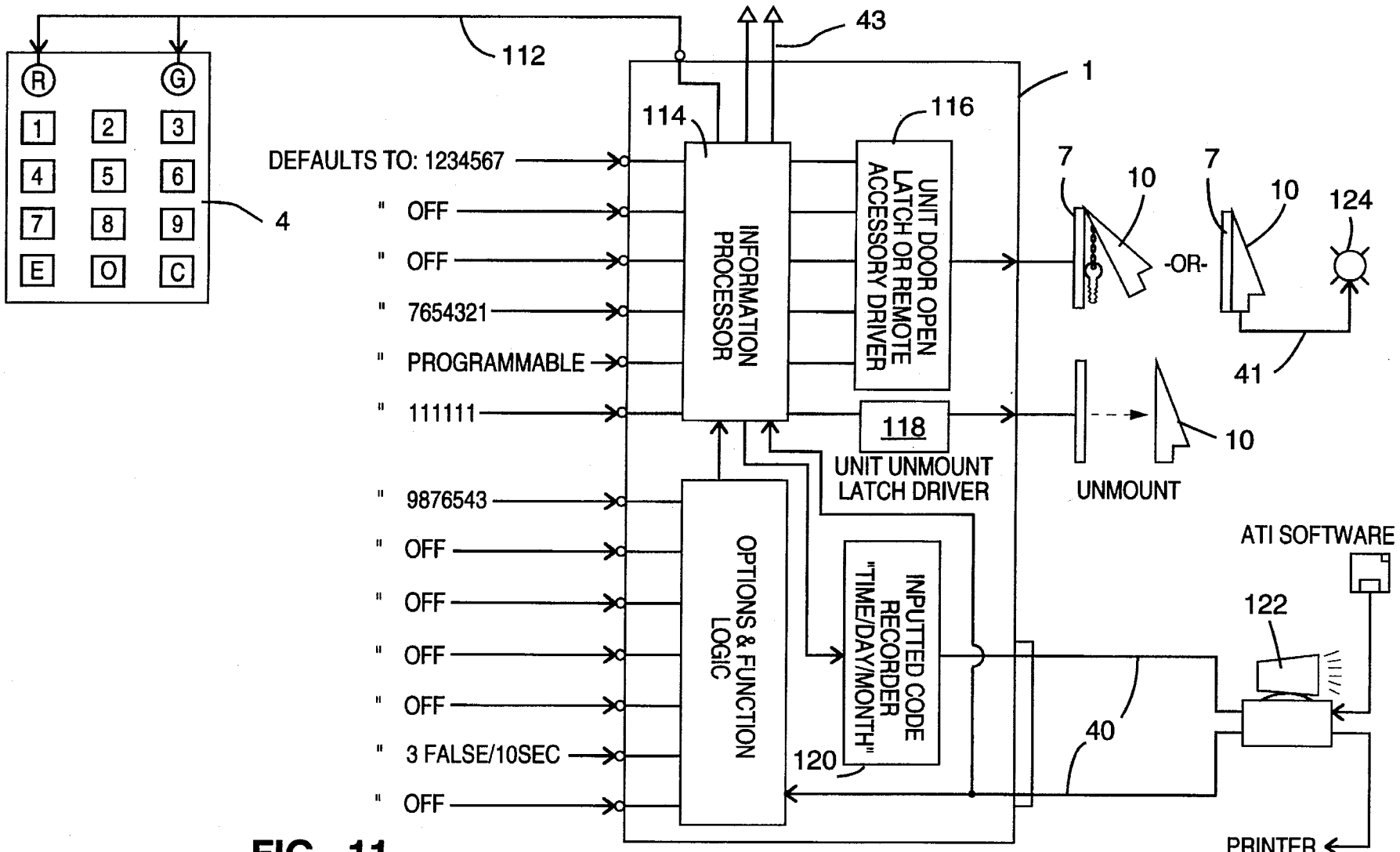
FIG. 11 is block diagram of the internal electronics in accordance with the present invention are a schematic diagram of the internal electronics shown in FIG. 11.

Referring to FIG. 11, there is illustrated the internal electronics of the unit that is mounted on the electronics printed circuit board (PCB) 1. PCB 1, which is mounted to electronics member 8, contains the circuitry that activates coils 25 and 26 of outer housing latch assembly 2 and mounting latch assembly 3 in response to valid key codes being entered into the electronic code entry key pad assembly 4.

Specifically, when a key code has been entered into key pad assembly 4, the key code is transferred to PCB 1 via ribbon cable 112. The key code is received by a programmable information processor 114 that processes the key code in order to determine if it is a valid key code. The processor 114 determines the validity of the received key code by retrieving certain preprogrammed key code data from a digital memory located within the processor 114.

The preprogrammed key code data stored in the memory may correspond to many alternative valid key codes that may be entered in the key pad assembly 4 to activate one or both of the latch assemblies 2 and 3. In the preferred embodiment the possible valid key codes are:

1) A Master Code corresponding to a first level of security that controls all functions; there is one default code that can be changed;

2) A Fire/Emergency/Security Code corresponding to a second level of security; there is either one changeable or programmed unchangeable code;

3) A Manager/Supervisor/Maintenance Code corresponding to a third level of security; there is either one changeable or programmed unchangeable code;

4) A User Code corresponding to a fourth level of security; there are hundreds of programmed code combinations, or these codes can be programmed so the user can change them after the assigned code is entered;

5) A System Reset Code that is used to reset the entire system back to the default codes, except for the Master Code; there is one code;

6) An Identification Number entered by the programmer; there is one code;

7) An Upload/Download Code used for programming or retrieval of stored information; there is one code; and 8) A Mounting Latch Release Code for removal of the unit from its mounting bracket; there is one code.

Processor 114 compares the entered key code with the stored key code data. If processor 114 determines that a valid key code has been entered for activation and release of the outer housing latch assembly 2, a signal is transmitted to an outer housing latch driver 116 that in turn energizes coil 25. Alternatively, if processor 114 determines that a valid key code has been entered for activation and release of mounting latch assembly 3, a signal is transmitted to a mounting latch driver 118 that in turn energizes coil 26. The processor 114 preferably is programmed to keep the coils 25 and 26 energized for approximately four seconds. Thus, in response to the key pad assembly 4, PCB 1 activates and releases outer housing latch assembly 2 and mounting latch assembly 3.

PCB 1 may also provide the following functions:

1) A privacy lock out code which, when entered, will lock-up the unit for a programmable time of 30 minutes to 4 hours;

2) An automatic lockout code which when entered will lock-up the unit for a programmable time of 30 minutes to 23 hours;

3) Hundreds of automatically changing codes that can be programmed to change daily, weekly or monthly;

4) A programmable lockout mode lasting 1 to 30 seconds upon 1 to 5 false entries;

5) A system reset that causes the system to reset if a proper code is started and not completed within five seconds after the last number or letter is entered; and 6) A battery condition indicator that blinks the red LED when the batteries need to be replaced.

When a key code is entered via key pad assembly 4, processor 114 causes an input code recorder 120 to electronically store certain time data corresponding to the time when the key code was entered. This time data is usually the month, day and exact time that the key code was entered. Furthermore, an upload/download port 40 is provided on PCB 1 for uploading the electronically stored time data to an external digital system 122. The upload/download port can also be used as a programming port for receiving (or downloading) programming data from the external digital system 122.

PCB 1 includes internal power source circuitry for providing power from a power source located within outer housing 10 to all of the internal electronics that require power, such as key pad assembly 4, the circuitry on PCB 1, and coils 25 and 26. The internal power source that is located within outer housing 10 is preferably implemented by means of batteries positioned on PCB 1. Furthermore, PCB 1 preferably includes external power source circuitry 43 for providing power from a power source positioned outside the outer housing 10 to the internal electronics.

The external power source circuitry 43 may also be referred to as "jump start" circuitry 43. The purpose of the jump start circuitry 43 is to provide power to the unit in case of internal power source or battery failure. Circuitry 43 is preferably electrically isolated to guard against false inputs or high voltage attacks due to deliberate input tampering. Furthermore, circuitry 43 preferably includes electrical terminals which are accessible through one of the walls of the outer housing 10. These terminals allow power to be provided to the internal electronics by pressing a 9 Volt radio battery against the electrical terminals. While the battery is pressed against the terminals, the un-mount code entered, the unit is un-mounted, and the batteries are replaced.

PCB 1 preferably also includes a remote device control port 41. Remote device control port 41 provides for the activation or control of a remote device 124 by the key pad assembly 4. In other words, a remote and external device 124 can be activated in response to the entering of a valid key code in the key pad assembly 4. If such remote control is desired, outer housing latch assembly 2 is preferably disconnected and remote device 124 is connected to port 41. In addition, an optional in line relay 42 provides a dry set of electrical contacts for the operation of an electrical/mechanical external device(s) 124.

Examples of such external devices 124 that may be controlled with remote device control port 41 are any devices having an electrically controlled relay/switch. Basically, optional in-line relay 42 is used to activate a larger relay located in device 124. Thus, electric switches on doors or windows, burglar alarms, heating and air conditioning units, etc., may be controlled by the use of remote device control port 41. These devices may be turned on and off by entering a valid key code in key pad 4.

Figure 12:
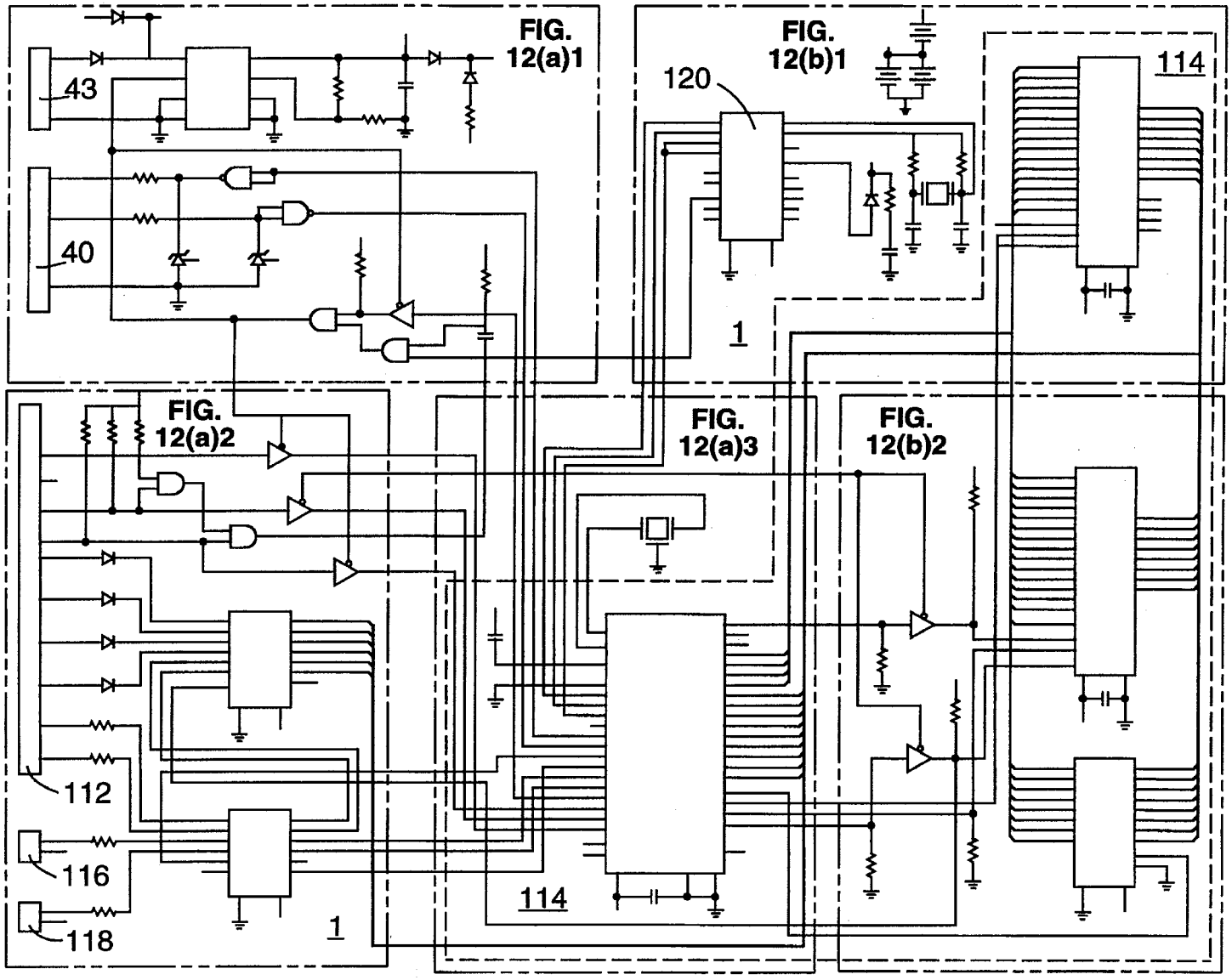

Referring to FIGS. 12(*a*) and 12(*b*), there is illustrated a schematic diagram of PCB 1. The electronics components, which preferably can operate in a wide range of temperatures and weather conditions, are preferably mounted with surfaced mounted technology and are of the CMOS variety for very low power consumption. One set of batteries will operate the electronics for many years with a minimum of 100,000 latch actuations. Furthermore, the CMOS devices have a "sleeping" function that extends the battery life. In other words, the main functions of PCB 1 are shut off until there is a keystroke that "wakes up" the unit.

The information processor 114 preferably includes a microprocessor U1, a random access memory (RAM) U2, and a read only memory (ROM) U3. The microprocessor U1 may be a model 8031 which is manufactured by a number of different companies, including Intel Corp. of Santa Clara, Calif., and Oki Semiconductor of Tokyo, Japan. The RAM U2 may be any of several RAMs such as models 6264 to 62256, and the ROM U3 may be any of several ROMs such as models 2764 to 27C256, which are all manufactured by the above named companies.

The microprocessor U1 processes the key code data in order to determine whether a valid key code was entered in to key pad 4. All of the date data and the alternative key code data are stored in the RAM U2, and the system software is stored in the ROM U3. The system software coordinates the comparison of the entered key code and the stored key code data and the storage of the date data.

The date data is generated by the real time clock U6 which may be a model CDP68HC68T1M, manufactured by Harris of Melburne, Fla. Both the outer housing latch driver 116 and the mounting latch driver 118 are driven by a driver U5 which may be a model MIC 5801 or MIC 5800, manufactured by Micron of Boise, Id. Finally, jump start terminals 43 may be implemented by a low voltage regulator VR1 which may be a model LM2931C, manufactured by National Semiconductor Corporation of Santa Clara, Calif.

Figure 13:
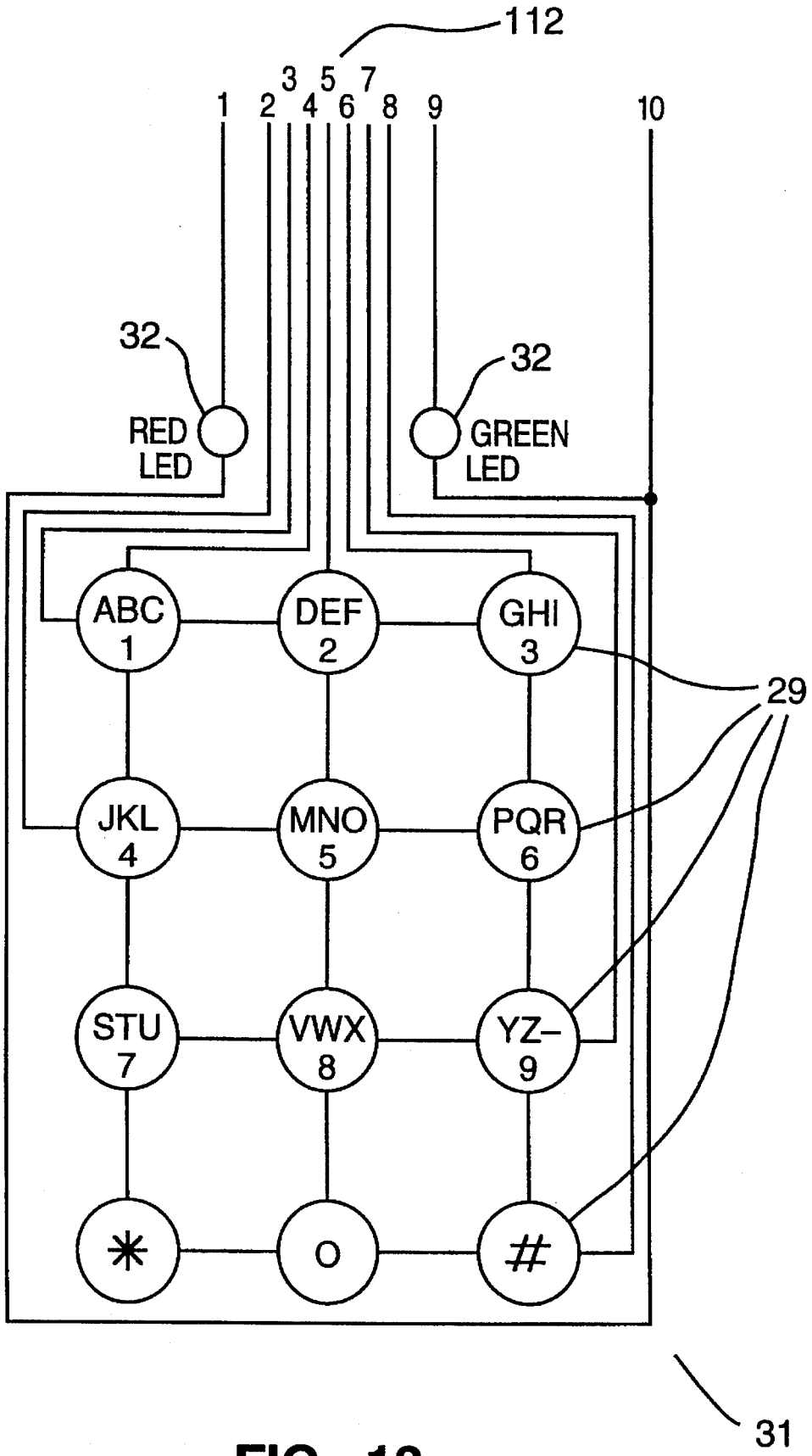
FIG. 13 is a schematic diagram illustrating the electrical connections of the key pad assembly of the present invention.

Referring to FIG. 13, there is illustrated a schematic diagram illustrating the manner in which the ribbon cable 112 is connected to the key pad assembly 4. The connections are in accordance with standard dual tone telephone configuration, well known in the present art.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A key safe comprising:

an outer housing for housing a key, the outer housing having walls defining an interior region;

mounting means for mounting said outer housing to a surface;

opening means for permitting said outer housing to be moved from a closed position to an open position, thereby allowing access to said interior region;

electronic code entry means positioned on the exterior of said outer housing walls for permitting entry of key codes; and activation means positioned in said interior region of said outer housing and responsive to said electronic code entry means for selectively releasing said mounting means and said opening means in response to entry of said key codes.

2. A key safe according to claim 1, wherein said mounting means comprises:

a mounting member mountable on a mounting surface;

an electronics member positioned within said outer housing and coupled thereto along one of said walls; and mounting latch means for latching said electronics member to said mounting member.

3. A key safe according to claim 2, wherein:

said electronics member includes slide mounting means for mating with a complimentary slide mounting means on said mounting member so that said electronics member may be removed from said mounting member by a sliding motion; and said mounting latch means is capable of preventing said sliding motion.

4. A key safe according to claim 1, wherein said opening means comprises:

a hinge connecting said mounting means and said outer housing for permitting said movement from said open position to said closed position; and an outer housing latch means for latching said outer housing in said closed position.

5. A key safe according to claim 1, further comprising:

a cover for providing protection to said electronic code entry means, said cover being connected to said outer housing.

6. A key safe according to claim 1, further comprising:

a U-shaped shackle for mounting said key safe to an object, said shackle being connected to said mounting means.

7. A key safe according to claim 2, wherein the mounting latch means comprises:

a first electrical coil;

a first armature pivotally attached to said first electrical coil; and a first holding bar pivotally attached to said electronics member for engaging with said mounting member;

wherein, said first armature engages with said first holding bar to prevent said electronics member from being separated from said mounting member when said first electrical coil is not energized and said first armature disengages from said first holding bar to permit said electronics member to be separated from said mounting member when said first electrical coil is energized.

8. A key safe according to claim 4, wherein the outer housing latch means comprises:

a second electrical coil;

a second armature pivotally attached to said second electrical coil; and a second holding bar pivotally attached to said mounting means for engaging said outer housing;

wherein, said second armature engages with said second holding bar to prevent said outer housing from opening when said second electrical coil is not energized and said second armature disengages from said second holding bar to permit said outer housing to open when said second electrical coil is energized.

9. A key safe comprising:

an outer housing for housing a key, the outer housing having walls defining an interior region;

an electronics member positioned within said outer housing;

a mounting bracket;

a mounting latch for latching said electronics member to said mounting bracket;

an outer housing latch for latching said outer housing to said electronics member;

an electronic code entry assembly accessible to a user for entry of a key code; and latch activation means positioned in the interior region of said outer housing and responsive to said electronic code entry means for selectively releasing said mounting latch and said outer housing latch in response to entry of a preprogrammed key code.

10. A key safe according to claim 9, further comprising:

a hinge connecting said outer housing to said electronics member so that access may be gained to the interior region of said outer housing by rotating said outer housing from a closed position to an open position.

11. A key safe according to claim 9, wherein:

said electronics member includes mounting slides for mating with complimentary mounting slides on said mounting bracket so that said electronics member may be removed from said mounting bracket by a sliding motion when said mounting latch is in an open position.

12. A key safe according to claim 9, wherein said mounting bracket comprises:

a U-shaped shackle for mounting said key safe to a door knob.

13. A key safe according to claim 9, wherein said mounting latch comprises:

a first electrical coil;

a first armature pivotally attached to said first electrical coil;

a first holding bar pivotally attached to said electronics member for engaging with said mounting member;

wherein, said first armature engages with said first holding bar to prevent said electronics member from being separated from said mounting member when said first electrical coil is not energized and said first armature disengages from said first holding bar to permit said electronics member to be separated from said mounting member when said first electrical coil is energized.

14. A key safe according to claim 9, wherein said outer housing latch comprises:

a second electrical coil;

a second armature pivotally attached to said second electrical coil; and a second holding bar pivotally attached to said electronics member for engaging said outer housing;

wherein, said second armature engages with said second holding bar to prevent said outer housing from opening when said second electrical coil is not energized and said second armature disengages with said second holding bar to permit said outer housing to open when said second electrical coil is energized.

15. A key safe comprising:

an outer housing for housing a key, the outer housing having walls defining an interior region;

hinge means for permitting said outer housing to be rotated from a closed position to an open position;

outer housing latch means for latching said outer housing in said closed position;

electronic code entry means positioned in one or more of said walls and exposed to the exterior of said outer housing so that said code entry means is accessible to a user for entry of a key code;

housing latch activation means positioned within said outer housing and responsive to said electronic code entry means for releasing said outer housing latch means upon entry of a key code;

internal power source circuitry means for providing power from a power source positioned within said outer housing to said electronic code entry means and said latch activation means; and external power source circuitry means for providing power from a power source positioned outside said outer housing to said electronic code entry means and said latch activation means, said external power source circuitry means serving as an alternative to said internal power source circuitry means.

16. A key safe according to claim 15, wherein:

said external power source circuitry means comprises an electrical terminal accessible through said outer housing walls for allowing power to be provided to said electronic code entry means and said outer housing latch means by way of said terminal.

17. A key safe according to claim 15, further comprising:

mounting means for releasably mounting said outer housing to a mounting surface so that said outer housing may be completely removed from said mounting surface when said mounting means is released; and mounting latch activation means responsive to said electronic code entry means for releasing said mounting means upon entry of a key code.

18. A key safe according to claim 17, wherein said mounting means comprises:

a mounting bracket; and an electronics member positioned within said outer housing and coupled thereto along one of said walls by said hinge means.

19. A key safe according to claim 18, wherein:

said electronics member includes slide mounting means for mating with complimentary slide mounting means on said mounting bracket so that said electronics member may be removed from said mounting bracket by a sliding motion; and said mounting latch means prevents said sliding motion when in a closed position.

20. A key safe comprising:

an outer housing for housing a key, the outer housing having walls defining an interior region;

hinge means for permitting said outer housing to be rotated from a closed position to an open position;

outer housing latch means for latching said outer housing to a mounting surface in said closed position;

electronic code entry means positioned on the exterior of said outer housing walls for permitting entry of key codes;

latch activation means positioned within said outer housing and responsive to said electronic code entry means for releasing said outer housing latch means upon entry by a user of a valid key code;

recording means for digitally storing time and key code data when said valid key code is entered; and a data transfer port connectable directly to an external computer for uploading said digitally stored time and key code data to said external computer.

21. A key safe according to claim 20, wherein said latch activation means comprises:

memory means for storing key code data corresponding to a plurality of alternative valid key codes; and processing means for retrieving and processing said key code data to determine whether a valid key code has been entered in said electronic code entry means.

22. A key safe according to claim 20, wherein said latch activation means comprises:

remote device control means for activating a remote device upon said entry by said user of said valid key code, said remote device control means including a remote access port for interfacing with said remote device.

23. A key safe according to claim 20, further comprising:

mounting means for releasably mounting said outer housing to said mounting surface so that said outer housing may be completely removed from said mounting surface when said releasable mounting means is released.

* * * * *